US005143222A

United States Patent [19]

Monteith

[11] Patent Number: 5,143,222

[45] Date of Patent: Sep. 1, 1992

[54] SIEVING APPARATUS

[75] Inventor: John Monteith, Twickenham, United Kingdom

[73] Assignee: Russell Finex Limited, London, England

[21] Appl. No.: 596,749

[22] Filed: Oct. 11, 1990

Related U.S. Application Data

[63] Continuation of Ser. No. 324,930, Mar. 17, 1989, abandoned.

[30] Foreign Application Priority Data

Nov. 14, 1988 [GB] United Kingdom ..... 8826610

[51] Int. Cl.[5] ..... B07B 1/42

[52] U.S. Cl. ..... 209/364; 209/365.1; 310/325

[58] Field of Search ..... 209/346, 364, 365.1, 209/368; 310/325

[56] References Cited

U.S. PATENT DOCUMENTS

| | | | |
|---|---|---|---|
| 3,049,255 | 8/1962 | Newburg | 209/346 |
| 3,140,859 | 7/1964 | Scarpa | 310/325 X |
| 3,183,378 | 5/1965 | McCracken | 310/325 |
| 3,210,580 | 10/1965 | Bodine, Jr. | 310/325 |
| 3,331,589 | 7/1967 | Hammitt et al. | 310/325 X |
| 3,694,675 | 9/1972 | Loveday | 310/325 |
| 3,772,538 | 11/1973 | Spitov | 310/325 |
| 4,062,768 | 12/1977 | Elliot | 209/341 |
| 4,816,144 | 3/1989 | Monteith | 209/364 |

FOREIGN PATENT DOCUMENTS

| | | | |
|---|---|---|---|
| 0203566 | 12/1986 | European Pat. Off. | 209/364 |
| 0233066 | 8/1987 | European Pat. Off. | 209/346 |
| 2120654 | 11/1971 | Fed. Rep. of Germany | 310/325 |
| 2528727 | 6/1982 | France . | |
| 0217985 | 9/1988 | Japan | 310/325 |
| 1094218 | 12/1967 | United Kingdom . | |
| 1462866 | 1/1977 | United Kingdom | 209/364 |

*Primary Examiner*—Donald T. Hajec
*Attorney, Agent, or Firm*—Kinney & Lange

[57] ABSTRACT

Sieving apparatus has a piezoelectric transducer directly bonded to a grating (100), the transducer comprising a number of piezoelectric elements (1) sandwiched between first and second bodies (2,3 ). The first body (2) is in two parts (2A, 2B) which are releasably secured together (6, 7), one part (2B) being directly bonded (5) to the grating (100). The arrangement allows use of a transducer with different gratings with different parts (2B) of a first body (2) bonded thereto in order to achieve a required operational mode.

5 Claims, 1 Drawing Sheet

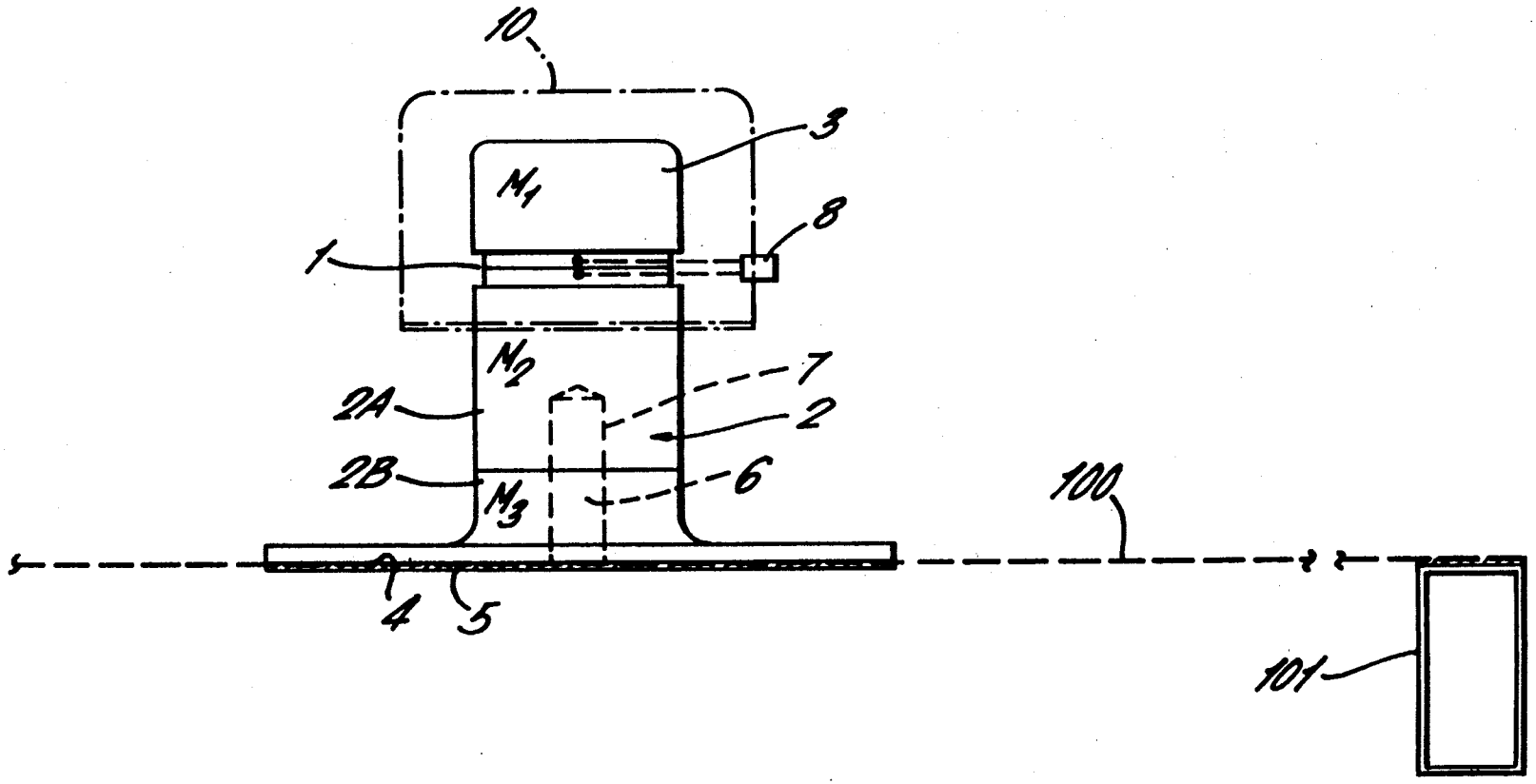
101
100
10
3
8
M1
1
7
2
M2
2A
6
M3
2B
5
4

SIEVING APPARATUS

This is a continuation of application Ser. No. 07/324,930 filed on Mar. 17, 1989, abandoned as of the date of this application.

BACKGROUND OF THE INVENTION

This invention relates to sieving apparatus.

In GB-A-1462866 there is described such apparatus, for sieving dry particulate material, comprising a base, a frame mounted on the base for vibratory movement with respect thereto, a grating attached to the frame, means for vibrating the frame relative to the base, and ultrasonic means coupled to the grating to effect ultrasonic vibration thereof relative to the frame.

In this known apparatus the ultrasonic means comprises an electro-mechanical transducer, and in particular a magnetostrictive transducer, the body of which is rigidly mounted with respect to the frame and which is coupled to the grating by means of a metal probe.

With such apparatus the low frequency vibration of the grating effected by the oscillation of the frame serves for bulk movement of material on the grating so that all layers of material are presented to the grating, while the high frequency vibration of the grating effected by the ultrasonic means serves to prevent blinding of the apertures of the grating otherwise caused by material adhering to the grating or by particles of the material locking together to bridge the apertures.

A disadvantage of such known apparatus is that the magnetostrictive transducer becomes hot and requires a supply of large volumes of cooling air to maintain a satisfactory temperature during operation. Further, the transducer is relatively large and heavy, and adds significantly to the mass to be oscillated.

In U.S. Pat. No. 4,816,144 there is described such an apparatus in which the ultrasonic means comprises a piezoelectric transducer directly bonded to the grating.

This known apparatus has the advantage that the transducer is relatively small and light, and does not require significant cooling during operation. Further, the transducer is tunable, and can be provided with means for frequency control, and preferably automatic control, whereby the optimum amplitude range of the ultrasonic vibrations of the grating for most effective operation of the apparatus can be achieved and maintained.

The transducer can be energised by a supply circuit including means to sense resonance of the grating and any deviation therefrom, and feedback means operative in response to the output of said sensing means to control the supply to the transducer to maintain resonance of the grating.

A transducer as used in such apparatus has minimum impedance at resonance, and this impedance can be sensed and used to control the output of a free running oscillator by which the transducer is powered.

The impedance can be sensed by sensing the voltage across a resistor connected across the supply to the transducer, the sensed voltage being used as a feedback signal for control of the oscillator.

Although in the known apparatus described in GB-A-1462866 the frame is vibrated relative to the base, this is not essential, it being otherwise possible for the material being sieved to be conveyed to and from the grating by vacuum or pressure differential means, and or by gravity, the vibration of the grating relative to the frame imparted by the transducer being sufficient to effect sieving.

SUMMARY OF THE INVENTION

According to this invention there is provided sieving apparatus comprising a base, a frame mounted on the base, a grating attached to the frame, and ultrasonic means coupled to the grating to effect ultrasonic vibration thereof relative to the frame, in which the ultrasonic means comprises a piezoelectric transducer comprising a piezoelectric element or elements sandwiched between first and second bodies of unequal mass, the first body being formed of two disengageable parts with a first part being sandwiched between the piezoelectric element or elements and the second part, and the second part providing a surface which is directly bonded to the grating.

An advantage of the apparatus of this invention is that the piezoelectric transducer apart from the second part of the first body, which is bonded to the grating, can be removed from the grating and used on another grating provided with the appropriate second part of a first body, such action being desirable, for example, when the original grating is to be serviced or a new grating is required for a different sieving operation. Further, it is thus also possible to use the transducer with first bodies of different masses, by appropriate choice of a grating with the required second part of a first body bonded thereto, thereby to obtain a required mode of vibration of the grating.

BRIEF DESCRIPTION OF THE DRAWING

This invention will be described by way of example with reference to the drawing which is a diagrammatic side elevational view through an ultrasonic transducer arrangement for use in apparatus according to the invention.

Suitable vibratory sieving apparatus to be modified to embody the present invention is disclosed in GB-A-1462866, and will not therefore be described in detail herein. The drawing shows an ultrasonic vibration means which replaces the magnetostrictive transducer of the known apparatus shown in GB-A-1462866.

DETAILED DESCRIPTION OF THE PREFERRED EMBODIMENTS

Referring to the drawing, this shows the grating 100 of a sieving apparatus carried by a frame 101. Mounted on the grating 100 is a piezoelectric transducer arrangement comprising a pair of piezoelectric elements 1 sandwiched between first and second bodies 2 and 3. The piezoelectric elements 1 can be pre-polarised lead titanate zirconate or similar elements, and while two are shown in the drawing it will be appreciated that any required number can be used. In a typical known transducer arrangement of this type the piezoelectric elements 1 are located near to the point of maximum stress in a half-wave resonant arrangement. Because the piezoelectric elements are pre-polarised they can be arranged to be mechanically aiding but electrically opposing whereby both bodies 2 and 3 can be at earth potential. Typically the piezoelectric elements 1 and the bodies 2 and 3 are clamped in their sandwich arrangement by means of a high tensile bolt (not shown) which ensures that the piezoelectric elements 1 are in compression at maximum displacement of the arrangement. The electric supply to the piezoelectric elements 1 is indicated at 8.

To such a known arrangement there is added the feature that the first body 2 is formed of two disengageable parts 2A and 2B, with a first part 2A being sandwiched between the piezoelectric elements 1 and the second part 2B, while the second part 2B provides a relatively large outwardly facing planar circular surface 4 which is directly bonded to the grating 100 by a layer of adhesive 5. The two parts 2A and 2B of the first body 2 are secured together by means of a threaded stud 6 extending from the second part 2B on the axis thereof and engaging in a threaded hole 7 in the first part 2A. The mass Ml of the second body 3 is different (smaller) than that of the combined masses M2 and M3 of the first and second parts 2A and 2B of the first body 2 plus the mass of the stud 6.

With this arrangement the sub-assembly comprising the piezoelectric elements 1, the body 3 and the part 2A of the body 2, which sub-arrangement can be a conventional piezoelectric transducer, can be removed from the part 2B and thus from the grating 100 and used on a different grating having an appropriate second part 2B of a body 2 bonded thereto. The transducer can thus be used in arrangements with different mass second parts 2B of a first body 2 whereby a required mode of vibration can be obtained.

The transducer arrangement has a cover 10 which is attached at the point of maximum stress and thus minimum amplitude of vibration whereby the cover 10 has the minimum effect on the operation of the transducer arrangement.

In use of the apparatus energisation signals are supplied (as indicated at 8) to the transducer 1 elements thereby to produce the required vibration of the grating 100.

The signals supplied to the transducer are controlled in dependence upon the operation of the apparatus, in order to obtain a required vibration of the grating 100 and thus effect the required sieving operation.

For efficient working it is desirable to maintain the grating 100 at resonance, under which condition the impedance of the transducer is a minimum. Any deviation from resonance will cause a change in the impedance and any such change can be used over a feedback connection to effect control of the signal supplied to the transducer a necessary to return the grating to resonance as required.

To ensure constant performance under varying load conditions and to protect the transducer form over stress, constant displacement of the transducer is maintained by the control circuitry.

Although in the apparatus specifically described above there is only a single transducer coupled to a single grating, it will be appreciated that an apparatus can be provided having a grating with one or more transducers which can be driven as described above, bonded thereto. The transducers can be driven at mutually different frequencies such that the vibrational nodes and antinodes at the two or more frequencies are at different positions on the grating whereby the maximum area of the grating is vibrated.

Apparatus as described above can be used for sieving liquids as well as dry particulate material.

I claim:

1. A sieving apparatus comprising a base, a frame mounted on the base, a grating attached to the frame, and at least one ultrasonic means coupled to the grating to effect ultrasonic vibration thereof relative to the frame, each of said at least one ultrasonic means comprising a piezoelectric transducer, the piezoelectric transducer comprising at least one piezoelectric element sandwiched between first and second bodies of unequal mass, wherein the first body is formed of a first part having a first diameter and a second part which are mutually disengageable, said first part being sandwiched between said at least one piezoelectric element and said second part, and said second part being plate-like to provide a planar circular surface of a diameter which is large relative to said first diameter, said surface being directly bonded to the grating.

2. Apparatus as claimed in claim 1, in which the two parts of the first body are secured together by means of a threaded member extending from the second part and engaging in a threaded hole in the first part.

3. Apparatus as claimed in claim 1, including a cover attached to the transducer at the point of maximum stress and minimum amplitude of vibration.

4. A sieving apparatus comprising a base, a frame mounted on the base, a grating attached to the frame, and at least one ultrasonic means coupled to the grating to effect ultrasonic vibration thereof relative to the frame, each of said at least one ultrasonic means comprising a piezoelectric transducer, the piezoelectric transducer comprising at least one piezoelectric element sandwiched between first and second bodies of unequal mass, wherein the first body is formed of a first part and a separate second part, the first part having one end adjacent said at least one piezoelectric element and another end adjacent said second part, said another end of the first part having a first diameter, and the second part having one end adjacent the first part of substantially the same diameter as the first diameter and an opposite end that is plate-like to provide a planar circular surface of a second diameter which is substantially larger than said first diameter, said surface being directly bonded to the grating to impart vibration to the grating.

5. A sieving apparatus according to claim 4 wherein the first body has a first mass and the second body has a second mass, said second mass being less than said first mass.

* * * * *

UNITED STATES PATENT AND TRADEMARK OFFICE

CERTIFICATE OF CORRECTION

PATENT NO. : 5,143,222

DATED : September 1, 1992

INVENTOR(S) : JOHN MONTEITH

It is certified that error appears in the above-identified patent and that said Letters Patent is hereby corrected as shown below:

On the Title page, item [56]

In the References Cited Section, under U.S. PATENT DOCUMENTS, delete "3,049,255" insert "3,049,235"

In the References Cited Section, under FOREIGN PATENTS DOCUMENTS, delete "0217985", insert "0217983"

Signed and Sealed this

Nineteenth Day of October, 1993

*Attest:*

Bruce Lehman

BRUCE LEHMAN

*Attesting Officer*

*Commissioner of Patents and Trademarks*